US010226115B2

(12) United States Patent
Matsuda

(10) Patent No.: US 10,226,115 B2
(45) Date of Patent: Mar. 12, 2019

(54) HAIRDRESSING CAPE

(71) Applicant: WAKO CLOTHING CO., LTD., Ama-shi, Aichi-ken (JP)

(72) Inventor: Ken'ichi Matsuda, Ama (JP)

(73) Assignee: WAKO CLOTHING CO., LTD., Aichi-ken (JP)

( * ) Notice: Subject to any disclaimer, the term of this patent is extended or adjusted under 35 U.S.C. 154(b) by 0 days.

(21) Appl. No.: 15/238,609

(22) Filed: Aug. 16, 2016

(65) Prior Publication Data

US 2017/0172286 A1 Jun. 22, 2017

(30) Foreign Application Priority Data

Dec. 18, 2015 (JP) ..... 2015-247745

(51) Int. Cl.
*A45D 44/08* (2006.01)
*A41F 1/00* (2006.01)

(52) U.S. Cl.
CPC ..... *A45D 44/08* (2013.01); *A41F 1/00* (2013.01)

(58) Field of Classification Search
CPC .. A41F 1/00; A41F 1/006; A41F 1/008; A41F 1/04
See application file for complete search history.

(56) References Cited

U.S. PATENT DOCUMENTS 2,853,758 A * 9/1958 Topf ..... A41F 1/00 2/2.17
2,969,548 A 1/1961 Herschensohn
4,014,054 A * 3/1977 Pasquarello ..... A45D 19/04 4/521
2003/0088902 A1* 5/2003 Levy ..... A41D 13/04 2/50
2010/0205712 A1* 8/2010 Bish ..... A45D 44/08 2/50
2015/0208787 A1* 7/2015 Matsuda ..... A45D 44/08 2/50

(Continued)

FOREIGN PATENT DOCUMENTS

DE 20 2009 001 148 U1 7/2009
FR 953479 A 12/1949
FR 1173725 A 3/1959

(Continued)

OTHER PUBLICATIONS

European Search Report for Application No. EP 16 18 3552 dated Aug. 30, 2017.

(Continued)

*Primary Examiner* — Andrew W Sutton
(74) *Attorney, Agent, or Firm* — Cheng Law Group, PLLC

(57) ABSTRACT

For a hairdressing cape, a round opening is formed at the center of an upper region of at least a front cloth and a back cloth, and a collar portion with an overlapping portion is formed which is sewn to a peripheral edge of the round opening by folding an edge portion. A clasp is mounted to an inner end portion at one side of the overlapping portion of the collar portion, and a ladder tape is mounted from near an end portion at the other side of the collar portion to an upper region of the back cloth. By making the clasp be caught and fastened in an arbitrary position of the ladder tape, the overlapping portion of the collar portion is fastened.

7 Claims, 12 Drawing Sheets

(56) References Cited

U.S. PATENT DOCUMENTS

| | | | | |
|---|---|---|---|---|
| 2015/0320180 | A1* | 11/2015 | McGuire ..... | A45D 44/08<br>2/50 |
| 2015/0374102 | A1* | 12/2015 | Velasquez, Jr. ..... | A45D 44/08<br>2/50 |

FOREIGN PATENT DOCUMENTS

| | | | |
|---|---|---|---|
| FR | 1188116 | A | 9/1959 |
| JP | 33-10929 | U | 7/1958 |
| JP | 34-5844 | U | 7/1959 |
| JP | 47-34325 | Y | 10/1972 |
| JP | 54-142021 | U | 10/1979 |
| JP | 56-87806 | U | 7/1981 |
| JP | 11-318561 | A | 11/1999 |
| JP | 2005-323996 | A | 11/2005 |
| JP | 3119583 | U | 3/2006 |
| JP | 3177791 | U | 8/2012 |
| JP | 2014-94100 | A | 5/2014 |

OTHER PUBLICATIONS

Notification of Reasons for Refusal for the Application No. 2015-247745 from Japan Patent Office dated Jul. 30, 2018.
Notification of Reasons for Refusal for the Application No. 2015-247745 from Japan Patent Office dated Jun. 7, 2018.

* cited by examiner

HAIRDRESSING CAPE

BACKGROUND OF THE INVENTION

1. Field of the Invention

The present invention relates to a hairdressing cape for use in a hair salon or a barber shop when cutting or washing hair to protect the clothing of a wearer from dirt and so on.

2. Description of Related Art

A hairdressing cape for use when cutting or washing hair to protect the closing of a wearer from dirt and so on is commonly comprised of a sheet of fabric including a front cloth and a back cloth. The fabric includes a round opening at the center of its upper region for receiving a neck, around which is a collar portion. An overlapping section is commonly provided at opposite ends of the collar portion or at the center of the back cloth, vertically, for fastening with a hook-and-loop fastener. Also, in a sleeved cape, as described in JP11-318561A, the sleeves are sewn to opposite sides of an upper region of the front cloth and back cloth.

Meanwhile, this type of hairdressing cape, as described above, usually includes a hook-and-loop fastener provided on the collar portion in order to fasten the overlapping section of the collar portion, and the hook-and-loop fastener is usually provided with a hook-like raised portion raised in a hooking manner and a loop-like raised portion raised in a looping manner.

In a hair salon or a barber shop, the hairdressing cape is used, when cutting or washing hair for a customer to wear, in a manner of fitting the collar portion of the cape around his/her neck part and pressing the hook-like raised portion and the loop-like raised portion of the hook-and-loop fastener provided at opposite sides of the collar portion to be stuck fast so as to close the collar portion.

However, the hook-like raised portion and the loop-like raised portion of a hook-and-loop fastener easily collect lint and the like to be attached to their surface, and particularly while haircutting, cut hair is likely to be attached. Also, even when the hook-and-loop fastener is in a fastened state where the hook-like raised portion and the loop-like raised portion overlap each other, cut hair enters through a gap therebetween the inside of the hook-and-loop fastener of the collar portion, and is attached to the hook-like raised portion or the loop-like raised portion.

Therefore, after repeated use of the hairdressing cape, hair and lint attached to the surface of the hook-and-loop fastener becomes less likely to fall off even when the cape is frequently washed, so that the dirt on the collar portion becomes easily noticeable. Therefore, when there is a desire to use the hairdressing cape for a long period of time in a clean condition, it has been necessary to frequently remove hair and lint attached to the surface of the hook-and-loop fastener.

Also, when a lot of hair and lint are attached to the hook-like raised portion or the loop-like raised portion of the hook-and-loop fastener, the hook-and-loop fastener is reduced in sticking force to result in a lower attaching force of the hook-and-loop fastener. Therefore, there has been a problem that repeated use of the hairdressing cape causes an unstable attaching state of the hook-and-loop fastener to make the collar portion likely to become defective in fastening condition.

SUMMARY OF THE INVENTION

It is an object of the present invention to provide a hairdressing cape a collar portion of which can be satisfactorily fastened and which can be used in a clean condition by preventing hair and the like from being attached.

The object of the present invention will be reached by the following hairdressing cape.

Specifically, a hairdressing cape of the present invention is a hairdressing cape for which a round opening is formed at the center of an upper region of at least a front cloth and a back cloth and a collar portion with an overlapping portion sewn to a peripheral edge of the round opening by folding an edge portion is formed, in which a clasp (Kohaze in Japanese) is mounted to an inner end portion at one side of the overlapping portion of the collar portion, a ladder tape is mounted from near an end portion at the other side of the collar portion to an upper region of the back cloth, and by making the clasp be caught and fastened in an arbitrary position of the ladder tape, the overlapping portion of the collar portion is fastened.

According to this hairdressing cape, when the cape is fitted on a wearer and the overlapping portion of its collar portion is fastened, by holding the clasp and overlapping the same on the ladder tape and fastening the same to be caught therein allows simply fastening the overlapping portion of the collar portion in a desired fastening condition and closing condition. Moreover, the ladder tape and clasp are much less likely to collect hair or lint to be attached than a hook-and-loop fastener, and can be used for a long period of time in a clean condition.

Here, it is preferable that the collar portion includes an elastic tape arranged by being inserted along its peripheral edge portion. Elasticity can thereby be produced in a contracting direction of the collar portion due to extension of the elastic tape when the clasp on an end portion of the collar portion is held and drawn, and therefore, making the clasp be caught and fastened in the ladder tape in this condition allows simply fastening the overlapping portion of the collar portion closely without a gap produced with respect to the neck, which allows fastening the collar portion easily and reliably.

Moreover, here, the clasp can be configured with an oval main body showing a substantially oval shape in a plan view being integrally molded of a synthetic resin with a mount base projecting from its lower end portion, a sheet-like base portion being fixed to a lower side of the mount base, and a base cloth being attached to a side close to the oval main body of the base portion. This allows easily molding the clasp of a synthetic resin and allows simply attaching the base cloth to the base portion. The clasp can be simply mounted to the collar portion by sewing the base cloth to the end portion of the collar portion.

Moreover, here, the clasp can be configured such that an oval main body showing a substantially oval shape in a plan view is formed of a synthetic resin in a tabular shape, a mount base is provided so as to project from a lower end portion of the oval main body, a sheet-like base portion is provided at a lower side of the mount base in parallel with the oval main body, the oval main body and the base portion are integrally molded of a synthetic resin via the mount base, and during the molding, a base cloth is attached to a plane close to the oval main body of the base portion. This allows easily molding the clasp by injection molding or the like of a synthetic resin and, during the molding, attaching the base cloth to the base portion at the same time. The clasp can be simply mounted to the collar portion by sewing the base cloth to the end portion of the collar portion.

Moreover, it is preferable that the oval main body of the clasp is provided with a tongue-shaped distal end portion and the tongue-shaped distal end portion is in a shape bent in an inclined manner so as to have an increasing interval with the base portion. This allows very easy fastening of the tongue-shaped distal end portion of the oval main body of the clasp in an arbitrary part of the ladder tape.

Moreover, here, the ladder tape can be configured with monofilament yarn being stitched back and forth between two tape-like base cloths disposed at an interval so as to stretch thereacross. This allows simply mounting the ladder tape by sewing the tape-like base cloths to the back cloth, and when using the cape, allows the clasp to be easily caught in the monofilament yarn at an arbitrary length position of the ladder tape for fastening. The collar portion of the hairdressing cape can thereby be satisfactorily fastened according to a wearer's shape.

Moreover, the monofilament yarn deteriorates little due to use, so the ladder tape can be used for a long period of time. Moreover, the ladder tape for which the monofilament yarn is stretched thereacross collects much less lint or hair to be attached than a hook-and-loop fastener, and can be used hygienically for a longer period of time in a cleaner condition.

Moreover, it is preferable that the ladder tape is sewn to the back cloth with an obliquely downward inclination from the collar portion. This allows more simply fastening the clasp on the outer overlapping portion in the ladder tape, allowing fitting the collar portion around the wearer's neck without a gap but in a loose fashion.

Moreover, the hairdressing cape can also be configured such that sleeves are sewn between opposite upper regions of the front cloth and back cloth, a round opening is formed at the center of an upper region of the front cloth, back cloth, and the sleeves, and a collar portion with an overlapping portion is provided which is formed by folding and sewing a peripheral edge portion of the round opening.

As above, the hairdressing cape of the present invention allows satisfactorily fastening its collar portion around a wearer's neck, and can be used in a clean condition by preventing hair and the like from being attached.

DESCRIPTION OF THE PREFERRED EMBODIMENTS

Embodiments of the present invention are described below with reference to the accompanying drawings. However, the invention is not limited to the embodiments disclosed herein. All modifications within the appended claims and equivalents relative thereto are intended to be encompassed in the scope of the claims.

Figure 1:
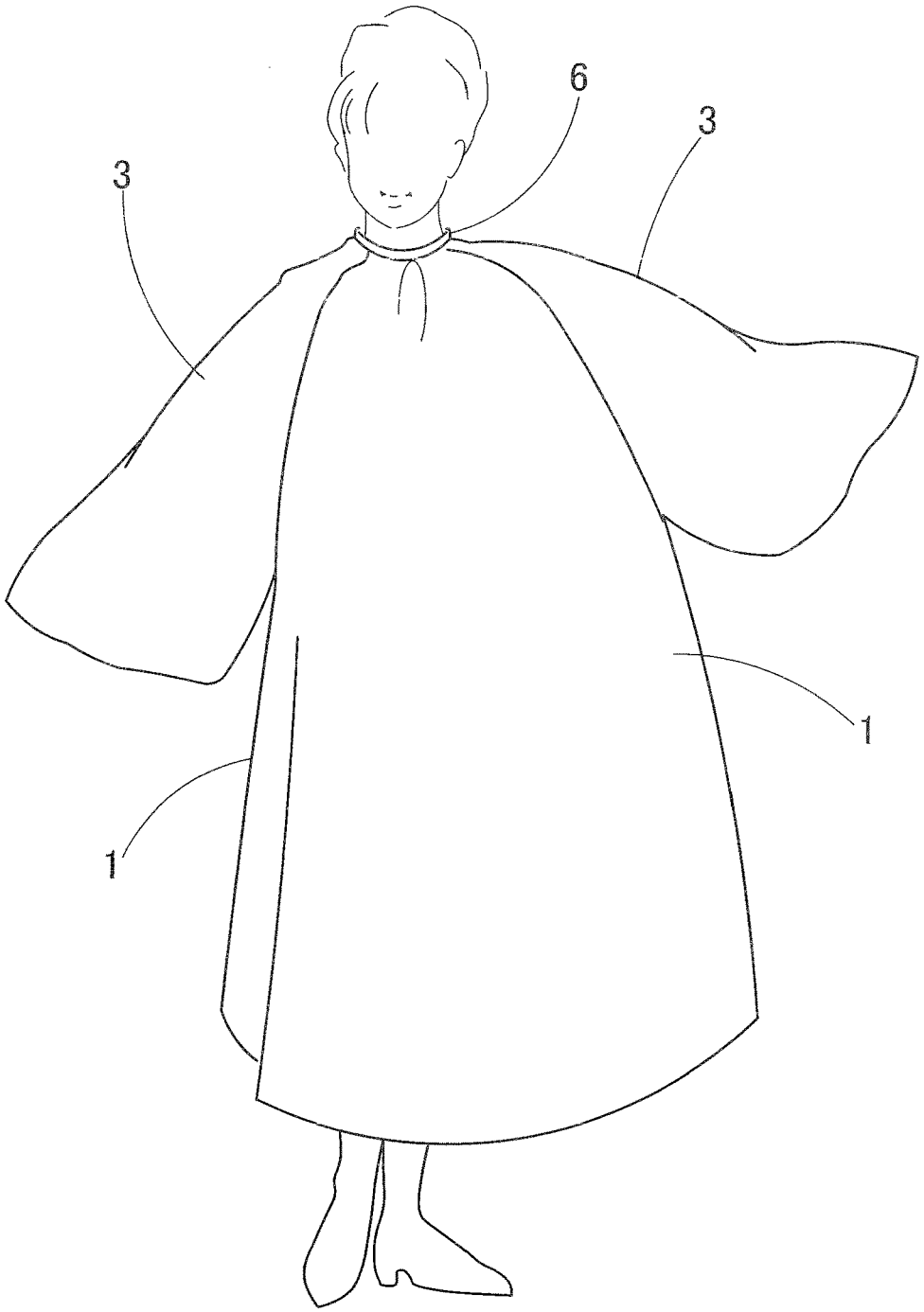
FIG. 1 is an overall configuration view of a hairdressing cape depicting an embodiment of the present invention.
Figure 2:
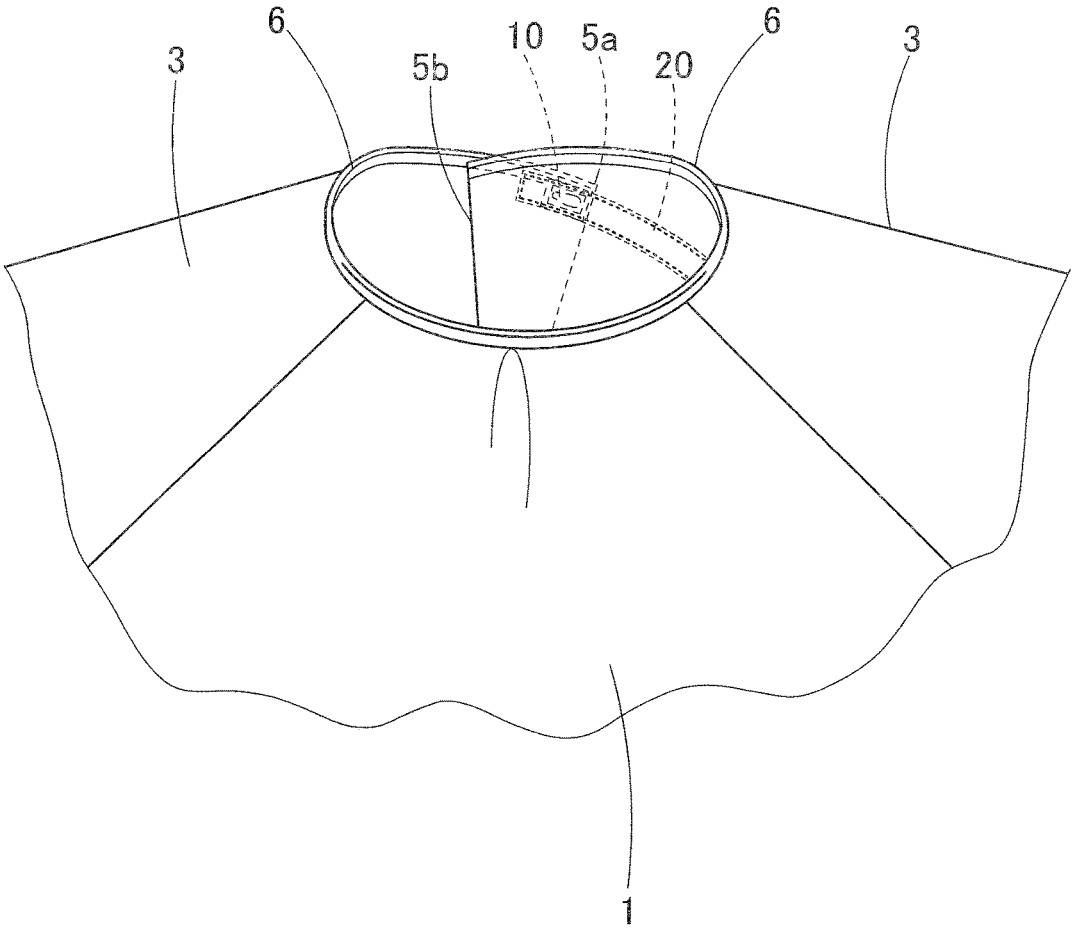
FIG. 2 is an enlarged perspective view of an upper part of the same hairdressing cape as viewed from the front.

FIG. 1 depicts an overall configuration view of a hairdressing cape. The cape includes a front cloth 1, a back cloth 2, and sleeves 3, all of which have water repellency, and as shown in FIG. 2, a round opening 7 is provided at the center of an upper region of the front cloth 1, back cloth 2, and sleeves 3, and a collar portion 6 with an overlapping portion 5 is formed on a peripheral edge portion of the round opening 7.

For the hairdressing cape, each of the sleeves 3 is sewn to upper regions of the front cloth 1 and the back cloth 2. The back cloth 2 is longitudinally halved such that the cape is openable/fastenable at the back. That is, the back cloth 2 has an overlapping portion 5. The front cloth 1, the back cloth 2, the sleeves 3, and the collar portion 6 are fabricated from a water-repellent cloth fabric such as nylon taffeta. Alternatively, the material of the cape may be other water-repellent fabric such as polyester taffeta and polyester tricot.

By using such water-repellent material as the cape cloth, the cape will be freed from infiltration of such liquid as water when such liquid adheres to the cape. Nylon taffeta and polyester taffeta can be crinkled to have irregularity on the surface. If the cape cloth is crinkled and has irregularity on the surface, cut hair will not likely stay on the cape surface and the hair will likely fall off.

If the cape is used for shampooing and so on, a waterproof cloth fabric is preferably used to fabricate the front cloth 1, back cloth 2, the sleeves 3, and the collar portion 6. By way of example, a polyester tricot cloth laminated with a thin polyethylene film or a polyester tricot cloth coated by a synthetic resin film layer can be used as such a waterproof cloth fabric.

As shown in FIG. 1, the hairdressing cape is formed by sewing the front cloth 1, the back cloth 2, and the right and left sleeves 3 together such that the round opening 7 is provided at the center of an upper end region of the cloths 1, 2 and sleeves 3 as shown in FIG. 2. The round opening 7 can be opened by separating the back cloth 2 longitudinally, thereby providing at the center of the upper end region a collar portion 6 openable at the back. The collar portion 6 is formed by sewing up an edge portion of the peripheral edge of the round opening 7, and a narrow elastic tape 8 is inserted through the inside of the collar portion 6 such that a moderate elastic contraction force is produced when one end of the round opening 7 of the collar portion 6 is held and drawn.

In addition, the elastic tape 8 of the collar portion 6 is arranged in the collar portion excluding a part to which a ladder tape 20 to be described later is sewn such that the ladder tape 20 is not deformed by the elastic tape 8. The collar portion 6 is formed with a narrow width on the order of, for example, 10 mm for suppressing the collar portion 6 from standing up when the overlapping portion 5 is overlapped and fastened, so as not to obstruct cutting scissors.

Figure 3:
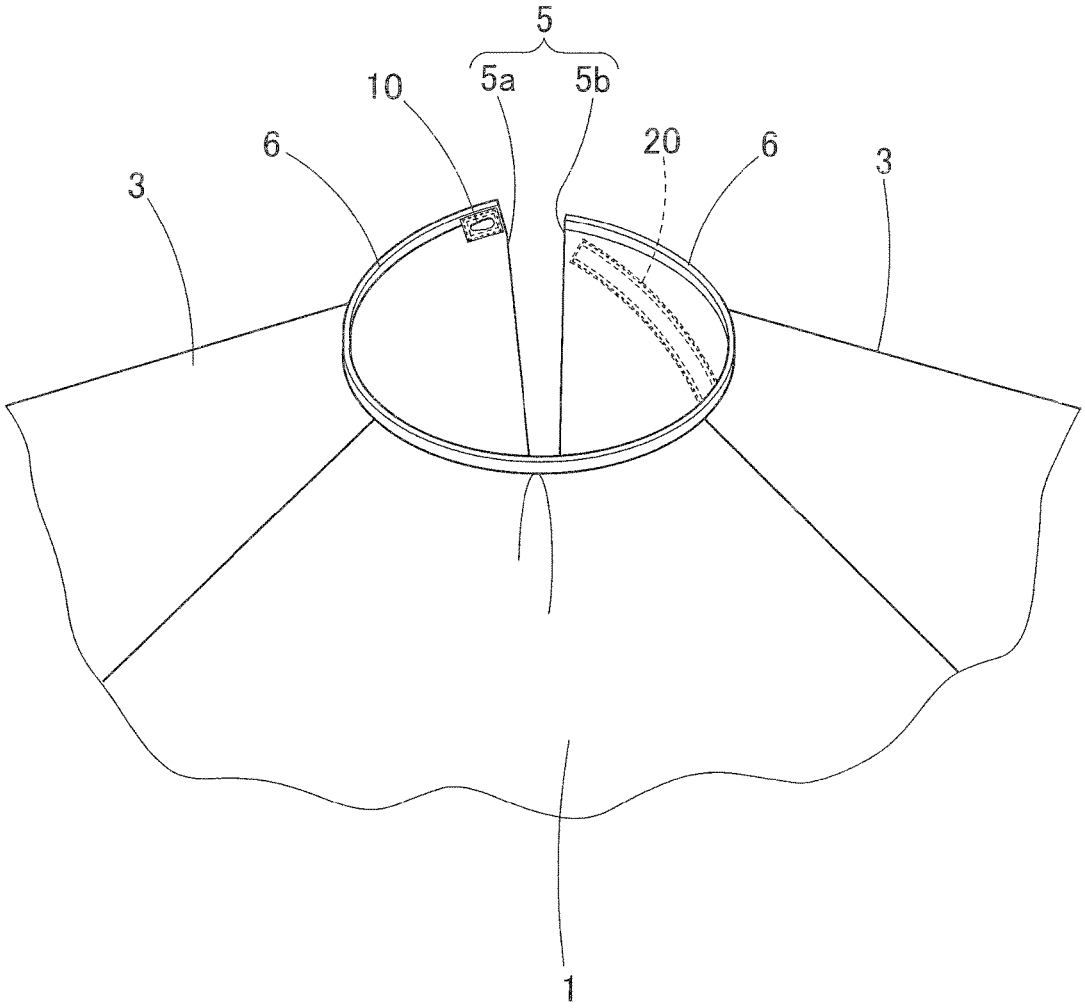
FIG. 3 is a partial perspective view of the hairdressing cape of FIG. 1 with its overlapping portion opened as viewed from the front.
Figure 4:
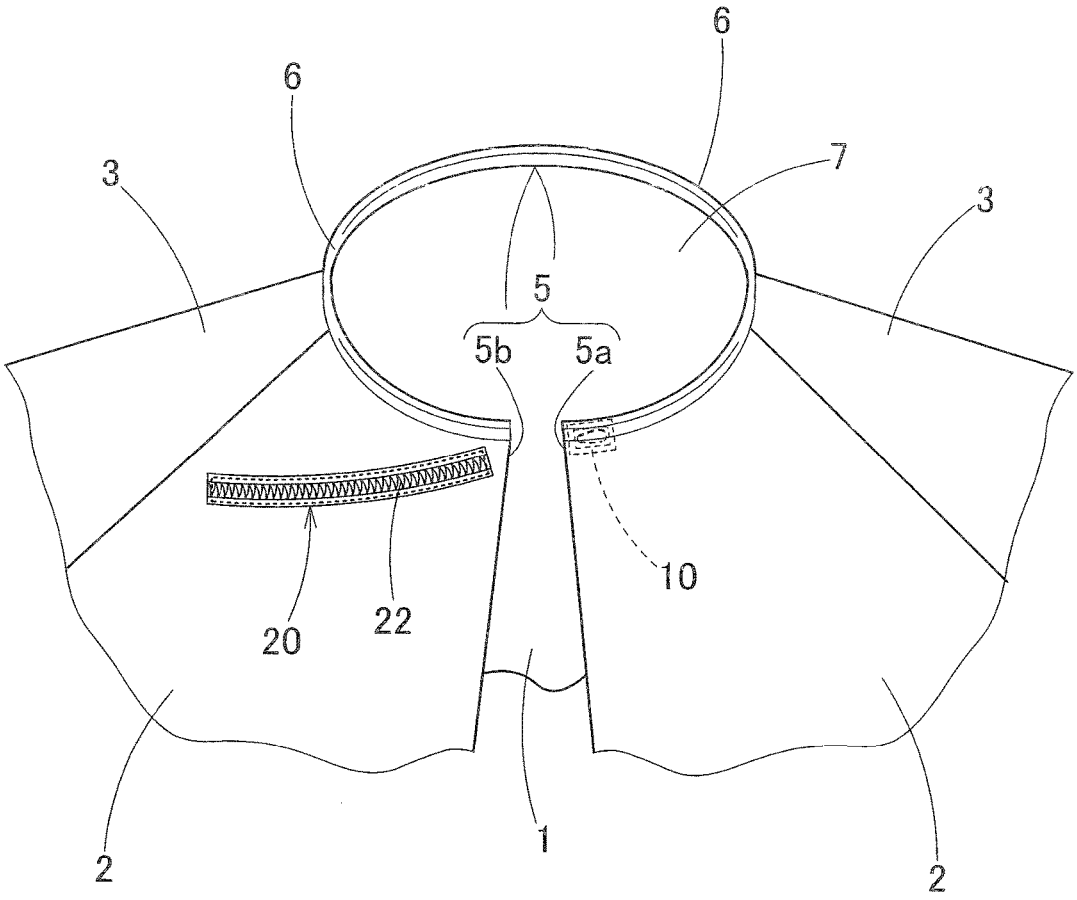
FIG. 4 is a partial perspective view of the hairdressing cape of FIG. 1 with its overlapping portion opened as viewed from the rear.

As described above, the back cloth 2 is halved longitudinally so the collar portion 6 is openable at the back as shown in FIG. 3 and FIG. 4, at which the overlapping portion 5 is formed. The collar portion 6 includes at one side of the overlapping portion 5 an outer overlapping portion 5*a* and at the other side of the overlapping portion 5 an inner overlapping portion 5*b*.

The overlapping portion 5 made up of the outer overlapping portion 5*a* and the inner overlapping portion 5*b* is fastened in such a manner that the outer overlapping portion 5*a* overlaps the inner overlapping portion 5*b* from outside, and for fastening the overlapping portion 5, a clasp 10 and a ladder tape 20 are sewn near the overlapping portion 5 so as to make the clasp 10 be caught in an arbitrary position of the ladder tape 20 such that the overlapping portion 5 is fastened.

Specifically, as shown in FIG. 3 and FIG. 4, in the overlapping portion 5, for fastening by overlapping over the opening therein, the clasp 10 is sewn to an inner side of the outer overlapping portion 5*a* of the collar portion 6 and the ladder tape 20 is sewn to an outer side of the inner overlapping portion 5*b* of the collar portion 6. The clasp 10 and the ladder tape 20 are structured such that the clasp 10 can be easily caught in an arbitrary position of the ladder tape 20 for fastening.

Figure 8A:
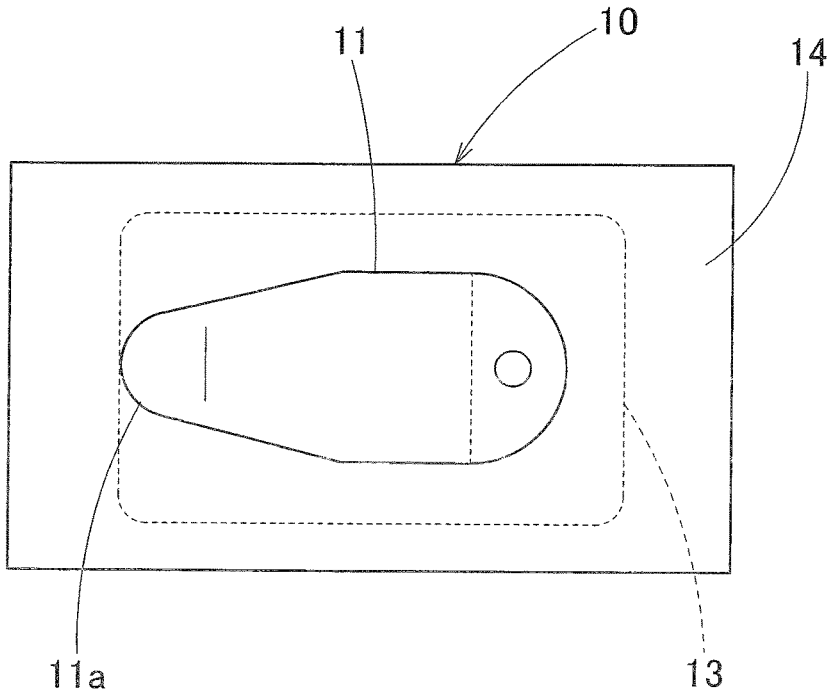
FIG. 8A is a plan view of the clasp.
Figure 8B:
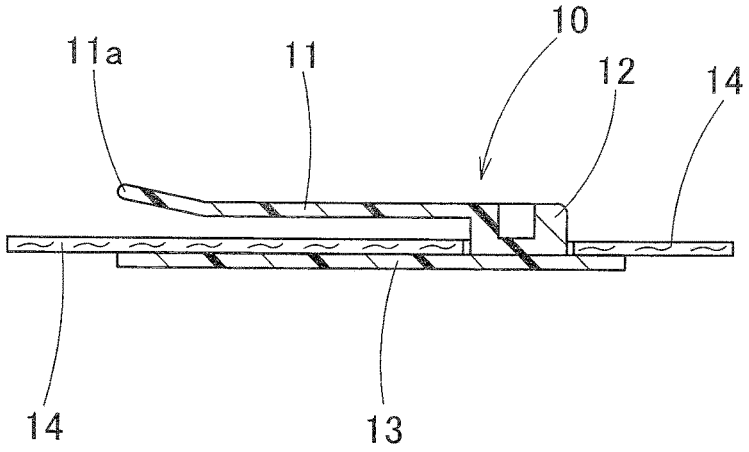
FIG. 8B is a sectional view of the clasp of FIG. 8A.

As shown in FIG. 8A, the clasp 10 is formed including an oval main body 11 showing a substantially oval shape in a plan view, and the oval main body 11 is integrally molded of a hard synthetic resin with a mount base 12 projecting from a lower side. As the hard synthetic resin, for example, a polyacetal resin (POM) can be used, which has sufficient strength and is excellent in spring-like resilience. As shown in FIG. 8A and FIG. 8B, the oval main body 11 is integrally formed on the mount base 12 so as to project substantially horizontally and forwardly, and at the distal end of the oval main body 11, a tongue-shaped distal end portion 11*a* is formed in a slightly bent manner so as to be oriented obliquely upward from a plane. That is, as shown in FIG. 8B, the oval main body 11 is formed at the distal end with the tongue-shaped distal end portion 11*a* in an inclined manner so as to have an increasing interval with a base portion 13. With this configuration, the clasp 10 has such a shape that allows the oval main body 11 to be easily caught in monofilament yarn 22 of the ladder tape 20.

As shown in FIG. 8B, under the oval main body 11, a space is formed by the mount base 12, and the monofilament yarn 22 of the ladder tape 20 is inserted in the space under the oval main body 11 to allow easy fastening. Further, at a lower side of the mount base 12, a tabular base portion 13 is fixedly attached in parallel with the oval main body 11. The base portion 13 is molded of the same hard synthetic resin as that for the oval main body 11, and is fixedly attached to the lower side of the mount base 12 by thermal bonding or gluing.

In the fixedly attaching step of the base portion 13, a rectangular shaped base cloth 14 is attached to an upper side of the base portion 13, that is, an upper face close to the oval main body 11 of the base portion 13. The base cloth 14 is formed using, for example, a polyester fabric, and is fixedly attached to the base portion 13 by gluing or thermal bonding.

This way, the base cloth 14 is fixedly attached to the upper face of the base portion 13 as shown in FIG. 8A and FIG. 8B, the mount base 12 penetrates through the base cloth 14, and the oval main body 11 is fixedly attached via the mount base 12 in parallel with the base portion 13. For the base cloth 14, a chemical fiber fabric such as a polyester fabric is used as a woven or knitted fabric. The base cloth 14 of a woven or knitted fabric can be permeated with a glue or molten resin, so the fixed attachment of the base portion 13 and the end portion of the mount base 12 may also be by fixedly attaching these by gluing or thermal bonding with the base cloth 14 interposed therebetween.

Figure 5:
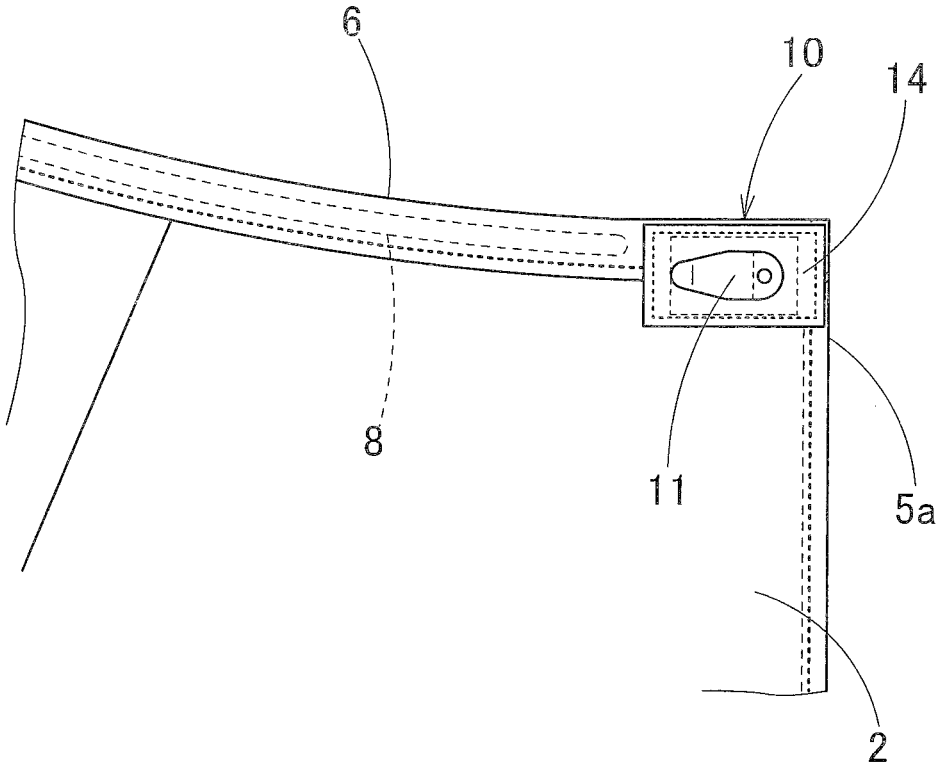
FIG. 5 is a partially enlarged perspective view of an outer overlapping portion as viewed from the inside.

As shown in FIG. 5, the clasp 10 thus configured is sewn by stitching its base cloth 14 to an inner side of the outer overlapping portion 5*a* of the overlapping portion 5 of the collar portion 6. This sewing is performed by stitching the base cloth 14 of the clasp 10 with an inner side of the outer overlapping portion 5*a* of the collar portion 6, thereby reliably attaching the base portion 13 of the clasp 10 in a state of being sandwiched between the collar portion 6 or the back cloth 2 and the base cloth 14 and thus not easily dropping.

It is noted that the clasp 10 may also be integrally molded in the oval main body 11, mount base 12, and base portion 13 described above by injection molding of a synthetic resin. In this case, a cavity for molding a clasp is formed in an injection molding die, and during molding, the synthetic resin such as a polyacetal resin is injected to the interior of the injection molding die with the base cloth 14 disposed at a fixed position in the cavity thereof.

The molten synthetic resin injected to the interior of the cavity permeates through the base cloth 14 between the base portion 13 and the mount base 12 to flow inside the cavity. For the clasp 10, the oval main body 11, mount base 12, and base portion 13 are thereby integrally molded of a synthetic resin, and during the molding, the base cloth 14 is also integrated by the permeating synthetic resin with the mount base 12 and the base portion 13.

Figure 6:
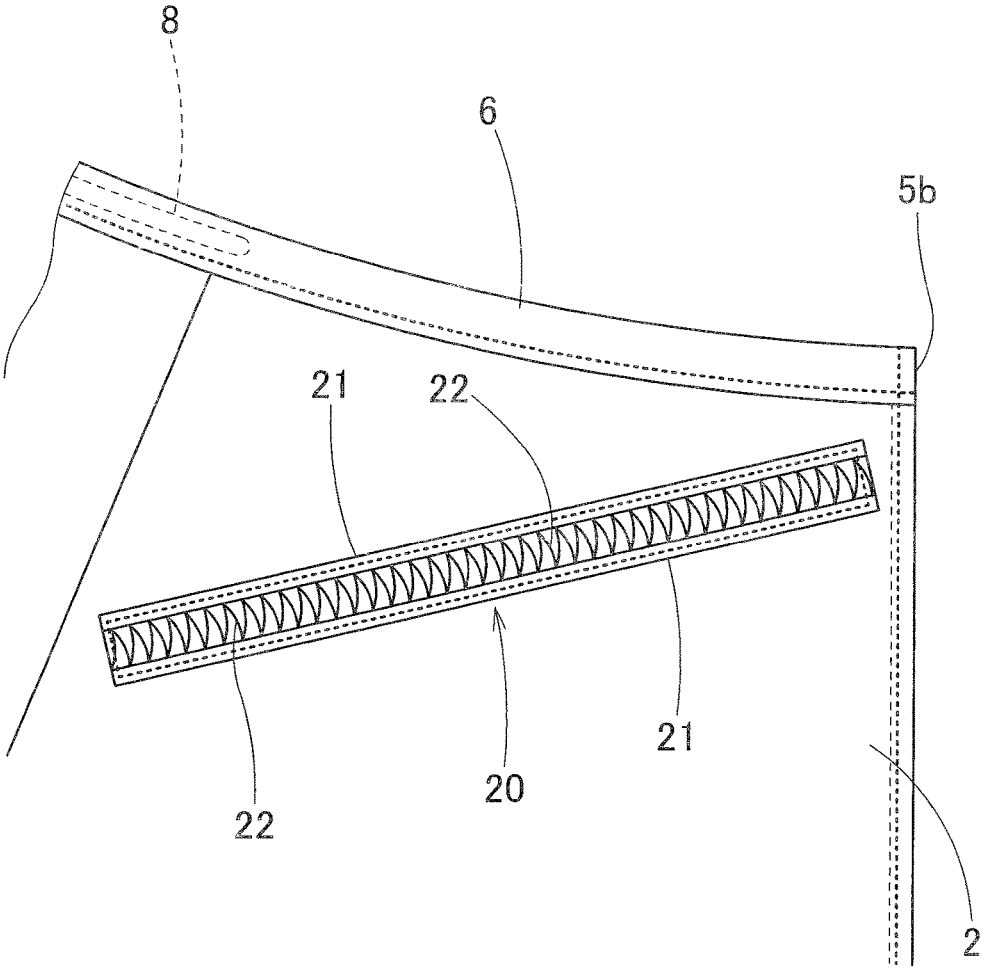
FIG. 6 is a partially enlarged perspective view of an inner overlapping portion as viewed from the outside.
Figure 7:
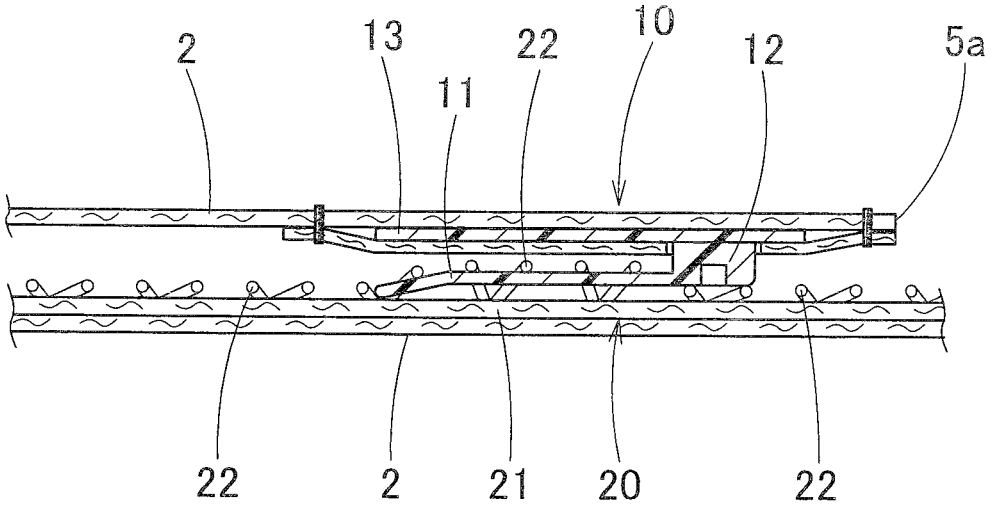
FIG. 7 is an enlarged sectional view of a clasp caught in a ladder tape.

As shown in FIG. 6 and FIG. 7, the ladder tape 20 is formed by disposing two long tape-like base cloths 21 in parallel at an appropriate interval and sewing the monofilament yarn 22 between the pair of tape-like base cloths 21 so as to be stretched back and forth thereacross. The tape-like base cloth 21 is formed as a knitted fabric by knitting a relatively thick synthetic fiber yarn into a band shape, thereby allowing easily weaving the monofilament yarn 22 into the tape-like base cloth 21.

For the monofilament yarn 22, monofilament yarn of, for example, nylon or polyethylene terephthalate is preferably used. The monofilament yarn 22 has such a thickness so as to have moderate rigidity, and for which one or two threads of yarn are stitched back and forth between the opposite tape-like base cloths 21 so as to draw arcs while stretching between the long base cloths. The pair of tape-like base cloths 21 are formed at an interval therebetween, that is, with a length of the monofilament yarn 22 stretched thereacross on the order of approximately 1.5 times the width of the oval main body 11 of the clasp 10 such that the clasp 10 can be easily caught in the monofilament yarn 22 of the ladder tape 20.

The ladder tape 20 can have an arbitrary length, but as shown in FIG. 4, setting the length to approximately five to six times the length of the clasp 10 allows satisfactorily latching the clasp 10 in an arbitrary position of the ladder tape 20 so as to make the collar portion 6 of the hairdressing cape fit a wearer's shape.

As shown in FIG. 6, the ladder tape 20 thus configured is sewn to an outside face of the back cloth 2 with the opposite tape-like base cloths 21 inclined, on an outer face of the inner overlapping portion 5*b* in the overlapping portion 5 of the back cloth 2, obliquely downward from a portion under the collar portion 6. The monofilament yarn 22 of the ladder tape 20 sewn to the back cloth 2 is slightly floating over the back cloth 2, which is a state in which the clasp 10 can be easily caught in.

The monofilament yarn 22 of the ladder tape 20 is in itself monofilament yarn to which lint or hair is unlikely to be attached, and one or two continuous threads of monofilament yarn are continuously weaved between the tape-like base cloths 21 and yarn end portions therefore do not appear at the surface, so lint or hair is very unlikely to attach. The monofilament yarn 22 of the ladder tape 20 is thus continuously weaved so as to be stretched back and forth between the tape-like base cloths 21 and does not have yarn end portions or hooked bent portions appearing as in a hook-and-loop fastener, and is therefore in a form in which lint or hair is very unlikely to be attached.

Figure 9A:
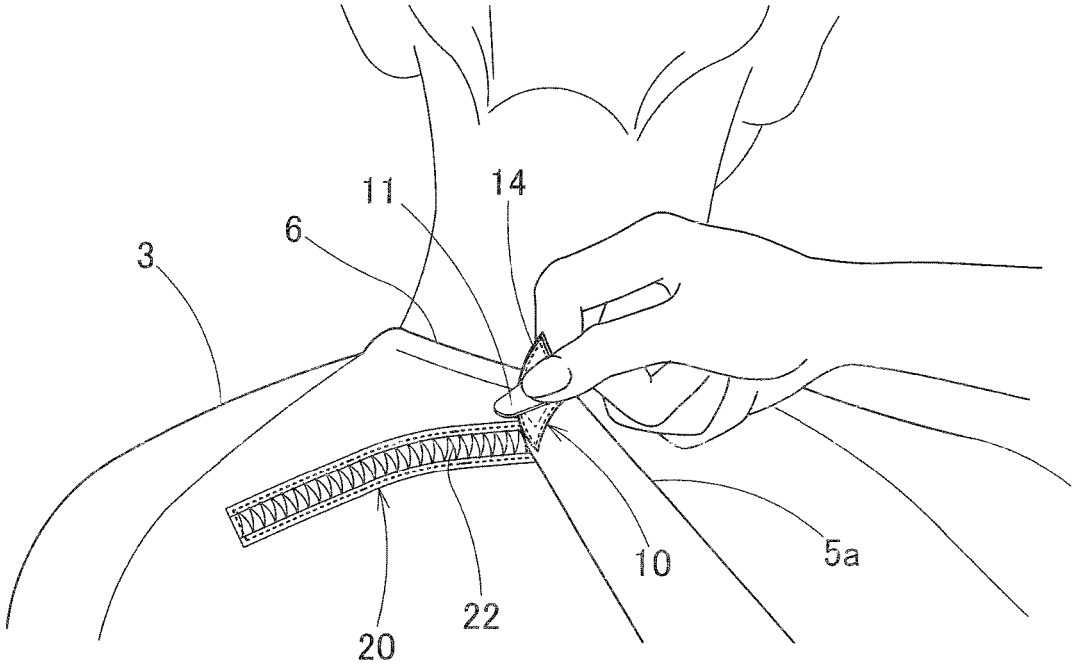
FIG. 9A is a rear view of the hairdressing cape when fastening the clasp in the ladder tape.

The hairdressing cape having the configuration described above is used in a beauty salon or a barber shop while haircutting and so on. When the cape is worn, the cape is firstly opened at the back cloth 2 and the sleeves 3 are put on the arms of the wearer, and then the collar portion 6 is fitted around the neck of the wearer, and as shown in FIG. 9A, the outer overlapping portion 5*a* with the clasp 10 in the overlapping portion 5 of the collar portion 6 is held and overlapped on the inner overlapping portion 5*b* at the other side.

Figure 9B:
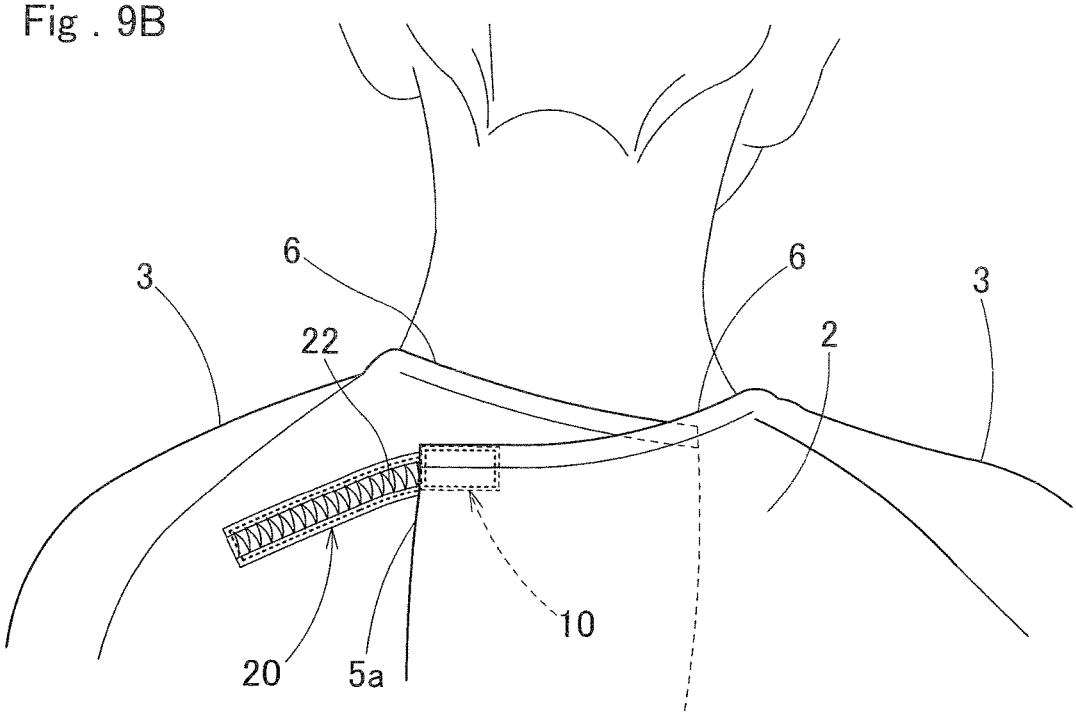
FIG. 9B is a rear view of the hairdressing cape with the clasp fastened in the ladder tape.

At this time, the outer overlapping portion 5*a* is held and slightly drawn obliquely downward, and in this state, the oval main body 11 of the clasp 10 is caught in an arbitrary position of the ladder tape 20. As shown in FIG. 9B, the oval main body 11 of the clasp 10 is thereby caught in the monofilament yarn 22 of the ladder tape 20.

At this time, a user slightly draws the clasp 10 obliquely downward and makes the clasp 10 on the inner side of the outer overlapping portion 5*a* be caught in the ladder tape 20 located in an upper region of the back cloth 2 near the wearer's shoulder, and therefore can make the clasp 10 be caught therein very simply and according to the wearer's shape. Also, at this time, due to the action of the elastic tape 8 placed in the collar portion 6, the clasp 10 is weakly drawn to be biased to a side to open the collar portion 6, and the clasp 10 is therefore simply latched in an arbitrary position of the long ladder tape 20 to be retained.

By the clasp 10 being thus caught in the ladder tape 20 in the overlapping portion 5 of the collar portion 6, as shown in FIG. 9B, the collar portion 6 of the cape is closely fitted around the wearer's neck without a gap. Also, because the clasp 10 has the oval main body 11 and the oval main body 11 can be simply caught in the monofilament yarn 22 at any part on the long ladder tape 20, the overlapping portion 5 of the collar portion 6 can be simply fastened according to the collar portion 6 and the wearer's shape or the fitting condition around the neck.

Also, when a barber or hairdresser cuts the wearer's hair, as shown in FIG. 9B, the collar portion 6 is closely fitted around the wearer's neck in a narrow shape without a standing-up part, and therefore, cutting scissors do not contact the collar portion 6, which allows the barber or hairdresser to satisfactorily perform a haircut without caring about the collar portion 6.

When unfastening the overlapping portion 5 of the collar portion 6, by holding the outer overlapping portion 5*a* with the clasp 10 and drawing the same slightly in an oblique direction, the collar portion 6 is extended slightly, so that the oval main body 11 of the clasp 10 comes out of the monofilament yarn 22 of the ladder tape 20 to allow easily unfastening the overlapping portion 5 of the collar portion 6.

Thus, with the hairdressing cape having the configuration described above, when fastening the overlapping portion 5 of the collar portion 6, holding the clasp 10 and placing the same in an arbitrary position of the ladder tape 20 and fastening the same to be caught therein allows simply fastening the overlapping portion 5 of the collar portion 6 in a desired fastening condition and closing condition. Moreover, hair or lint is unlikely to be attached to the ladder tape 20, not to mention the fact that hair or lint is not attached to the clasp 10, so the cape can be used for a much longer period of time in a much cleaner condition than a cape using a hook-and-loop fastener.

Figure 10:
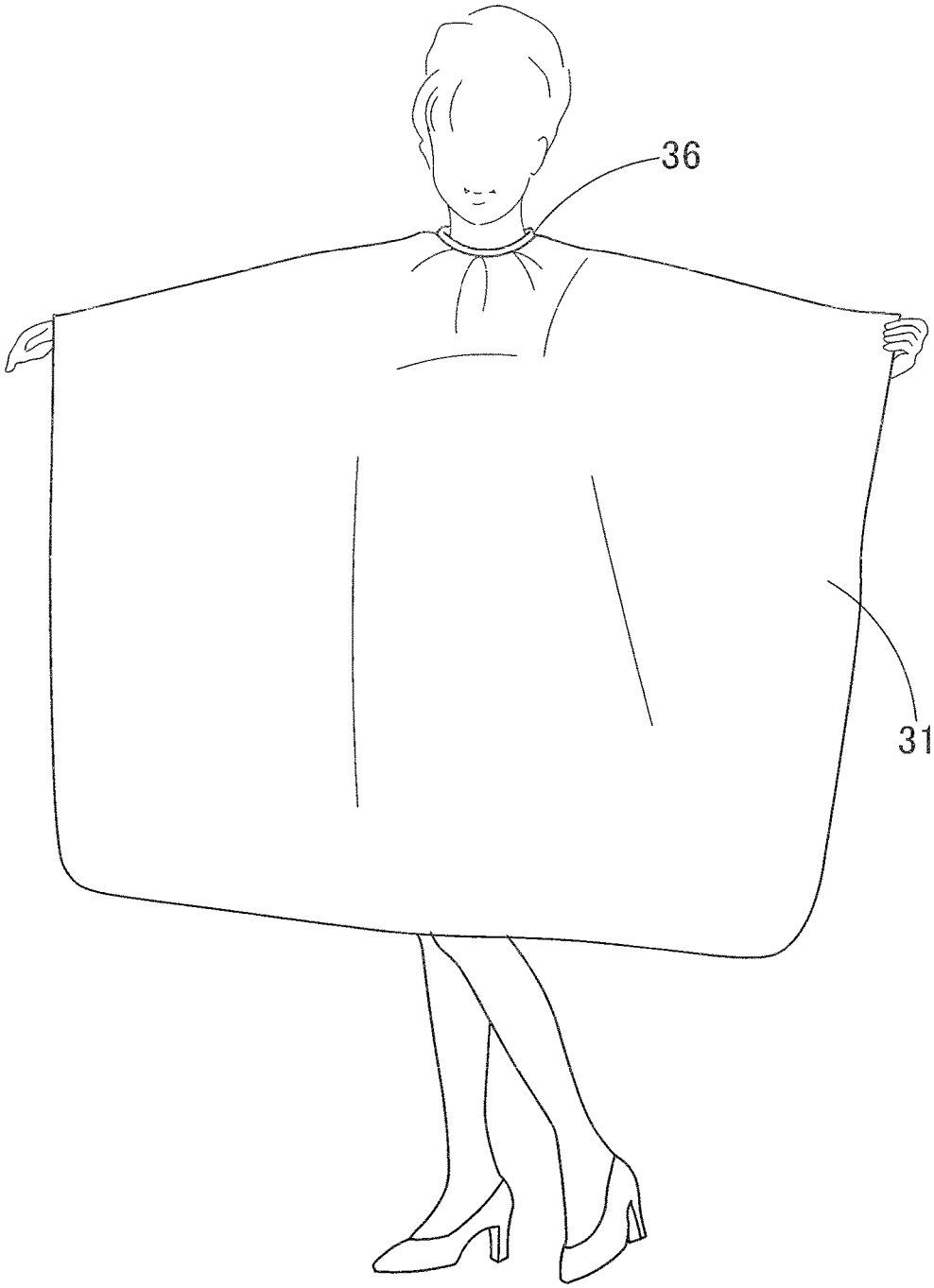
FIG. 10 is a configuration view of a hairdressing cape depicting another embodiment.
Figure 11:
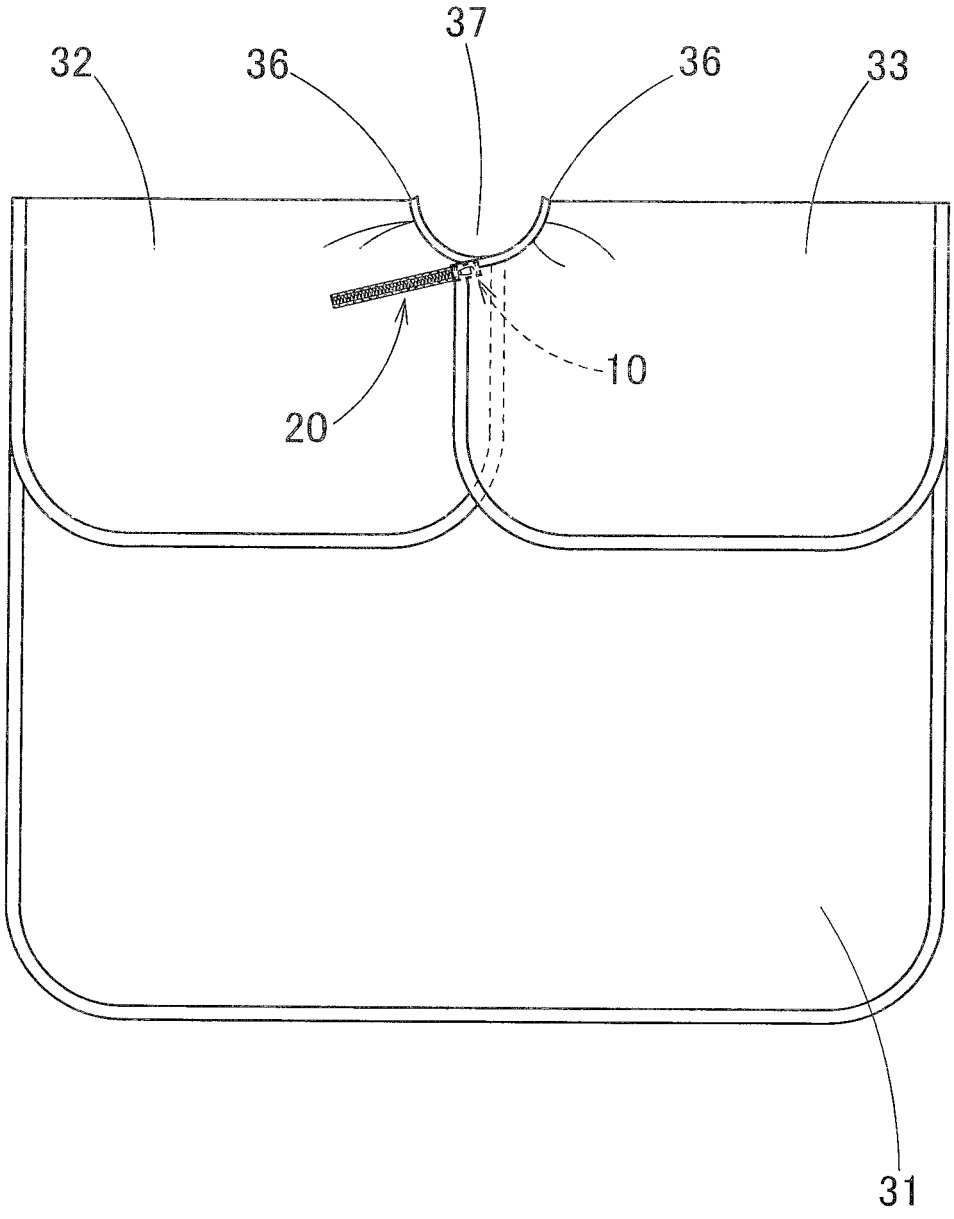
FIG. 11 is a rear view of the same hairdressing cape.
Figure 12:
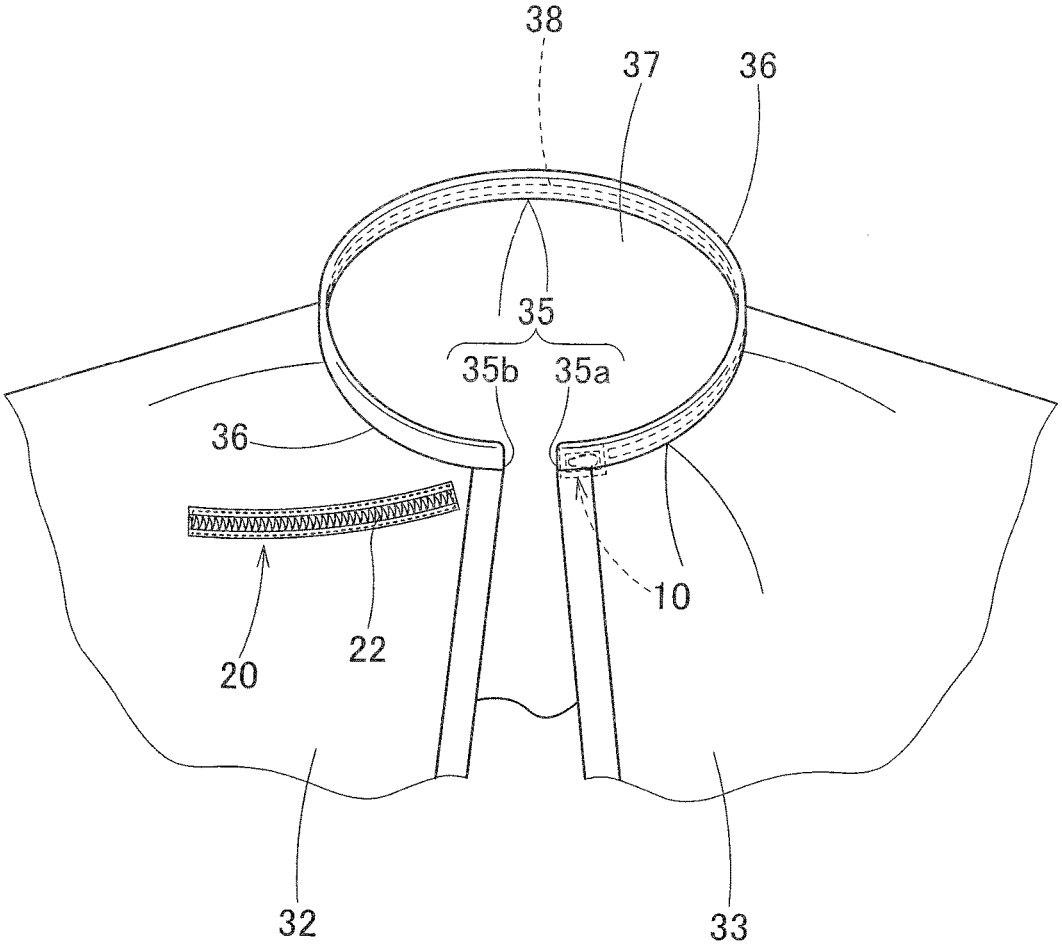
FIG. 12 is a partial rear perspective view of the hairdressing cape of FIG. 10 with its overlapping portion opened as viewed from the rear.

FIG. 10 to FIG. 12 depict a hairdressing cape of another embodiment. As shown in FIG. 10, the hairdressing cape is a sleeveless type and does not include the sleeves described above, and only a front cloth 31 and back cloths 32 and 33 compose the hairdressing cape. A round opening 37 is provided at the center of an upper region of the front cloth 31 and back cloths 32 and 33 having water repellency or water proofing property. On a peripheral edge portion of the round opening 37, a tape-like cloth is stitched in a covering manner to form a collar portion 36 with an overlapping portion. As shown in FIG. 12, in the collar portion 36, a narrow elastic tape 38 is inserted.

As shown in FIG. 11, the front cloth 31 and the back cloths 32 and 33 are continuous at their upper regions, the back cloths 32 and 33 have a construction longitudinally halved from the round opening 37 such that the cape is openable/fastenable at the back, and an overlapping portion 35 is formed near the collar portion 36 of the back cloths 32 and 33. As shown in FIG. 12, at one side of the overlapping portion 35 near the collar proton, an outer overlapping portion 35*a* is formed, and at the other side of the overlapping portion 5, an inner overlapping portion 35*b* is formed.

The overlapping portion 35 made up of the outer overlapping portion 35*a* and the inner overlapping portion 35*b* is fastened in such a manner that the outer overlapping portion 35*a* overlaps the inner overlapping portion 35*b* from outside. Similar to the above, for fastening the overlapping portion 35, a clasp 10 and a ladder tape 20 shown in FIG. 6 to FIG. 8 are sewn so as to make the clasp 10 be caught in an arbitrary position of the ladder tape 20 for fastening.

As shown in FIG. 12, in the overlapping portion 35, for fastening by overlapping over the opening therein, the clasp 10 is sewn to an inner side of the outer overlapping portion 35*a* of the collar portion 36 and the long ladder tape 20 is sewn to an outer side of the inner overlapping portion 35*b* of the collar portion 36. The clasp 10 can be easily caught in an arbitrary position of the ladder tape 20 for fastening.

Similar to the above, the clasp 10 is formed including an oval main body 11 showing an oval shape, and the oval main body 11 is integrally molded of a hard synthetic resin with a mount base 12 projecting from a lower side. The oval main body 11 is integrally formed on the mount base 12 so as to project substantially horizontally and forwardly, and at a lower side of the mount base 12, a base portion 13 is fixedly attached in parallel with the oval main body 11. Further, a base cloth 14 is attached to an upper face of the base portion 13.

It is noted that the clasp 10 can be integrally molded in its oval main body 11, mount base 12, and base portion 13 by injection molding of a synthetic resin, and during the molding, the base cloth 14 can also be attached in an integrated manner at the same time. As shown in FIG. 8B, at the distal end of the oval main body 11, a tongue-shaped distal end portion 11*a* is formed in a slightly bent manner so as to be oriented obliquely upward from a plane, which makes the oval main body 11 be easily caught in monofilament yarn 22 of the ladder tape 20. The clasp 10 is sewn by stitching its base cloth 14 to an inner side of the outer overlapping portion 35*a* of the collar portion 36.

Similar to the above, as shown in FIG. 6 and FIG. 7, the ladder tape 20 is formed by disposing two tape-like base cloths 21 in parallel at an appropriate interval and weaving the monofilament yarn 22 between the pair of tape-like base cloths 21 so as to be stretched thereacross. As shown in FIG. 12, the ladder tape 20 thus configured is sewn to an outer face of the inner overlapping portion 35*b* in the overlapping portion 35 of the back cloth 32 by stitching the opposite tape-like base cloths 21 to an outside face of the back cloth 32 so as to be inclined obliquely downward from the collar portion 36.

The hairdressing cape having the configuration described above is fitted on a wearer for use, and for which the outer overlapping portion 35*a* with the clasp 10 in the overlapping portion 35 of the collar portion 36 is held and overlapped on the inner overlapping portion 35*b* at the other side, and the outer overlapping portion 35*a* is held and slightly drawn obliquely downward, and the oval main body 11 of the clasp 10 is caught in an arbitrary position of the ladder tape 20.

At this time, the oval main body 11 of the clasp 10 is caught in the monofilament yarn 22 of the ladder tape 20 and due to the action of the elastic tape 8 placed in the collar portion 36, the clasp 10 is weakly drawn to be biased to a side to open the collar portion 36, and the clasp 10 is thereby simply latched in an arbitrary position of the long ladder tape 20 to be retained.

Thus, with the hairdressing cape having the configuration described above, when fastening the overlapping portion 35 of the collar portion 36, holding the clasp 10 on the outer overlapping portion 35*a* and overlapping the same on the inner overlapping portion 35*b* at the other side and fastening the oval main body 11 of the clasp 10 to be caught in the ladder tape 20 allows simply fastening the overlapping portion 35 of the collar portion 36 in a desired fastening condition and closing condition. Moreover, hair or lint is unlikely to be attached to the ladder tape 20, not to mention the fact that hair or lint is not attached to the clasp 10, so the cape can be used for a much longer period of time in a much cleaner condition than a cape using a hook-and-loop fastener.

What is claimed is:

1. A hairdressing cape comprising:

a collar portion with an overlapping portion sewn by folding an edge portion to a peripheral edge of a round opening formed at the center of an upper region of at least a front cloth and a back cloth;

a clasp mounted to an inner end portion at one side of the overlapping portion of the collar portion;

a ladder tape mounted from near an end portion at the other side of the overlapping portion of the collar portion to an upper region of the back cloth, wherein, by making the clasp be caught and fastened in an arbitrary position of the ladder tape, the overlapping portion of the collar portion is fastened, and wherein the clasp includes a synthetic resin-made and tabular, oval main body formed in a substantially oval shape in a plan view, a mount base projecting from a lower end portion of the oval main body, a sheet-like base portion fixed to a lower side of the mount base in parallel with the oval main body, and a base cloth attached to a plane close to the oval main body of the base portion.

2. The hairdressing cape according to claim 1, wherein the oval main body is formed at a distal end with a tongue-shaped distal end portion in an inclined manner so as to have an increasing interval with the base portion.

3. A hairdressing cape comprising:

a collar portion with an overlapping portion sewn by folding an edge portion to a peripheral edge of a round opening formed at the center of an upper region of at least a front cloth and a back cloth;

a clasp mounted to an inner end portion at one side of the overlapping portion of the collar portion;

a ladder tape mounted from near an end portion at the other side of the overlapping portion of the collar portion to an upper region of the back cloth, wherein, by making the clasp be caught and fastened in an arbitrary position of the ladder tape, the overlapping portion of the collar portion is fastened, and wherein the clasp includes a synthetic resin-made and tabular, oval main body formed in a substantially oval shape in a plan view, a mount base projecting from a lower end portion of the oval main body, a sheet-like base portion fixed to a lower side of the mount base in parallel with the oval main body, and a base cloth attached to a plane close to the oval main body of the base portion, and the oval main body and the base portion are integrally molded of a synthetic resin via the mount base.

4. The hairdressing cape according to claim 3, wherein the oval main body is formed at a distal end with a tongue-shaped distal end portion in an inclined manner so as to have an increasing interval with the base portion.

5. A hairdressing cape comprising:

a collar portion with an overlapping portion sewn by folding an edge portion to a peripheral edge of a round opening formed at the center of an upper region of at least a front cloth and a back cloth;

a clasp mounted to an inner end portion at one side of the overlapping portion of the collar portion;

a ladder tape mounted from near an end portion at the other side of the overlapping portion of the collar portion to an upper region of the back cloth, wherein, by making the clasp be caught and fastened in an arbitrary position of the ladder tape, the overlapping portion of the collar portion is fastened, and wherein through the collar portion, an elastic tape is inserted along a peripheral edge portion.

6. A hairdressing cape comprising:

a collar portion with an overlapping portion sewn by folding an edge portion to a peripheral edge of a round opening formed at the center of an upper region of at least a front cloth and a back cloth;

a clasp mounted to an inner end portion at one side of the overlapping portion of the collar portion;

a ladder tape mounted from near an end portion at the other side of the overlapping portion of the collar portion to an upper region of the back cloth, wherein, by making the clasp be caught and fastened in an arbitrary position of the ladder tape, the overlapping portion of the collar portion is fastened, and wherein the ladder tape includes two tape-like base cloths disposed in parallel at an interval and monofilament yarn stitched back and forth between the tape-like base cloths so as to stretch thereacross.

7. A hairdressing cape comprising:

a collar portion with an overlapping portion sewn by folding an edge portion to a peripheral edge of a round opening formed at the center of an upper region of at least a front cloth and a back cloth;

a clasp mounted to an inner end portion at one side of the overlapping portion of the collar portion;

a ladder tape mounted from near an end portion at the other side of the overlapping portion of the collar portion to an upper region of the back cloth, wherein, by making the clasp be caught and fastened in an arbitrary position of the ladder tape, the overlapping portion of the collar portion is fastened, and wherein the ladder tape is sewn to the back cloth with an obliquely downward inclination from the collar portion.

* * * * *